US006205289B1

(12) United States Patent
Kobro

(10) Patent No.: US 6,205,289 B1
(45) Date of Patent: Mar. 20, 2001

(54) STEAM GENERATION SYSTEM FOR INJECTING STEAM INTO OIL WELLS

(75) Inventor: Henrik Kobro, Stavanger (NO)

(73) Assignee: Den norske stats Oljeselskap a.s. (NO)

( * ) Notice: Subject to any disclaimer, the term of this patent is extended or adjusted under 35 U.S.C. 154(b) by 0 days.

(21) Appl. No.: 09/527,764

(22) Filed: Mar. 17, 2000

(51) Int. Cl.[7] ..... E21B 43/24

(52) U.S. Cl. ..... 392/303; 166/302; 166/57; 166/52

(58) Field of Search ..... 392/303, 301; 166/302, 303, 52, 57

(56) References Cited

U.S. PATENT DOCUMENTS 4,262,745 * 4/1981 Stewart ..... 166/303
4,322,603 * 3/1982 Bright ..... 166/57
4,408,665 * 10/1983 Dougan ..... 166/57
5,715,895 * 2/1998 Champness et al. ..... 166/57

* cited by examiner

*Primary Examiner*—John A. Jeffrey
(74) *Attorney, Agent, or Firm*—Quarles & Brady LLP

(57) ABSTRACT

A system for generation of steam for injection into a plurality of well bores in an oil field to improve the oil recovery from the oil field, wherein the system comprises a plurality of electric powered steam-generating units, each unit delivering steam for injection into a one well bore or a number of geographically close well bores, is described. Also described is steam-generating unit for the system and a use of a plurality of electric powered steam-generating units for generation of steam for injection into a plurality of well bores in an oil field to improve the oil recovery from the oil field.

9 Claims, 3 Drawing Sheets

STEAM GENERATION SYSTEM FOR INJECTING STEAM INTO OIL WELLS

BACKGROUND OF THE INVENTION

The present invention relates to an improved method and system for production of steam for steam injection in oil wells.

Many oil reservoirs contain heavy oil having a viscosity that makes it economically difficult or impossible to produce oil using conventional methods. Large oil reservoirs of this type are located in e.g. Venezuela The most common methods for recovering heavy, high viscosity oils comprises injection of steam into the reservoir. Steam enhances the production of heavy oil by reducing the viscosity by heating.

According to one method referred to as cyclic steam stimulation (CSS), steam is injected into a well for a period of several days to a few months. The well is then shut down for a period known as the soak period, before well is brought on production for a period. After this production period the same cycle is repeated.

According to another method known as steam drive, steam is injected into some wells dedicated to continuous steam injection at the same time as oil is produced in adjacent wells.

Today, steam for injection into wells is produced by means of gas fired boilers in a centralised unit on the field. The steam, having a temperature of approx. 300° C. and a pressure of about 100 bar, is transported from this unit to the wells by means of high pressure pipelines.

As an example, the area of an oil field may be 600 square km, and may have 40 or more clusters of wells, each cluster typically having approx. 10–50 wells. The investment costs in pipelines and steam generators are therefore substantial. The thermal loss in the pipelines is large.

SUMMARY OF THE INVENTION

The main objective of the invention is to obtain a system for decentralised generation of steam for injection into a plurality of well bores in an oil field to improve the recovery of crude oil from the oil field.

This objective is met by a system for generation of steam for injection into a plurality of well bores in an oil field to improve the oil recovery from the oil field, wherein the system comprises a plurality of electric powered steam-generating units, each unit delivering steam for injection into a one well bore or number of geographically close well bores.

Preferably, each steam-generating unit comprises an electric boiler supplied receiving electric power from an electric power distribution net.

Each steam-generation unit preferably comprises equipment for remote control.

It is preferred that each steam-generation unit also comprises a de-aerator.

Most preferably, each steam-generating unit is mounted on a separate transportable frame or skid for transport from one well bore to another.

Another object is to provide a steam-generating unit for generation of steam for injection into a well bore in an oil field to improve the oil recovery from the oil field.

This object is met by a steam-generating unit for generation of steam for injection into a well bore in an oil field to improve the oil recovery from the oil field, wherein said steam-generating unit comprises an electric boiler and additional equipment mounted on a transportable skid or frame for transport from one well bore to another.

It is preferred that each steam-generating unit also comprises equipment for remote control.

It is also preferred that each steam-generating unit comprises a de-aerator.

The invention also includes a use of a plurality of electric powered steam-generating units for generation of steam for injection into a plurality of well bores in an oil field to improve the oil recovery from the oil field, wherein each steam-generating unit delivers steam for injection into one well bore or a number of geographically close well bores.

BRIEF DESCRIPTION OF THE DRAWINGS

The invention will no be described with reference to a preferred embodiment and the enclosed figures, wherein.

DESCRIPTION OF THE PREFERRED EMBODIMENTS

Figure 1:
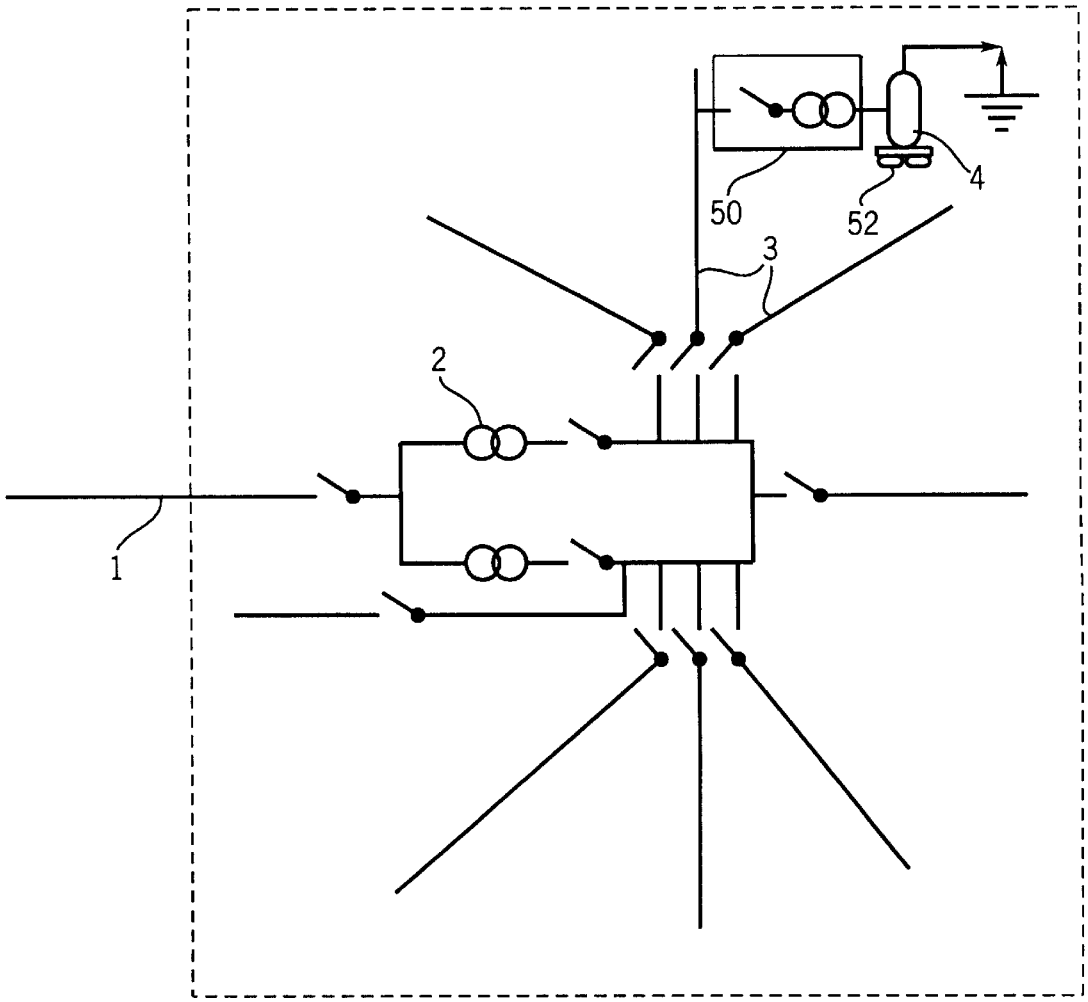
FIG. 1 is a principle drawing of an exemplary electric distribution system.

FIG. 1 illustrates the electric distribution system for an exemplary oil field having an area of about 600 km square and a plurality, i.e. 40 or more, cluster of well bores. Electric power for the steam generation is supplied through a main feed line 1. The power delivered in the main feed line 1 is transformed to a current suitable for distribution at the oil field and distributed to a plurality of distribution lines 3, by a centralised transformer and switch unit 2.

In the event that one electric boiler serves a cluster of geographically close wells, the boiler can be moved from well to well in a cyclic manner. As the injection period typically is much shorter than the soak period and the production period combined, this ensures high utilisation of the electric boiler.

Each distribution line 3 distributes power to one or more steam-generation units 4.

In the exemplary system, the main feed line has a capacity of 500 MW, whereas the power consumption of each steam-generation unit is about 6 MW.

Figure 2:
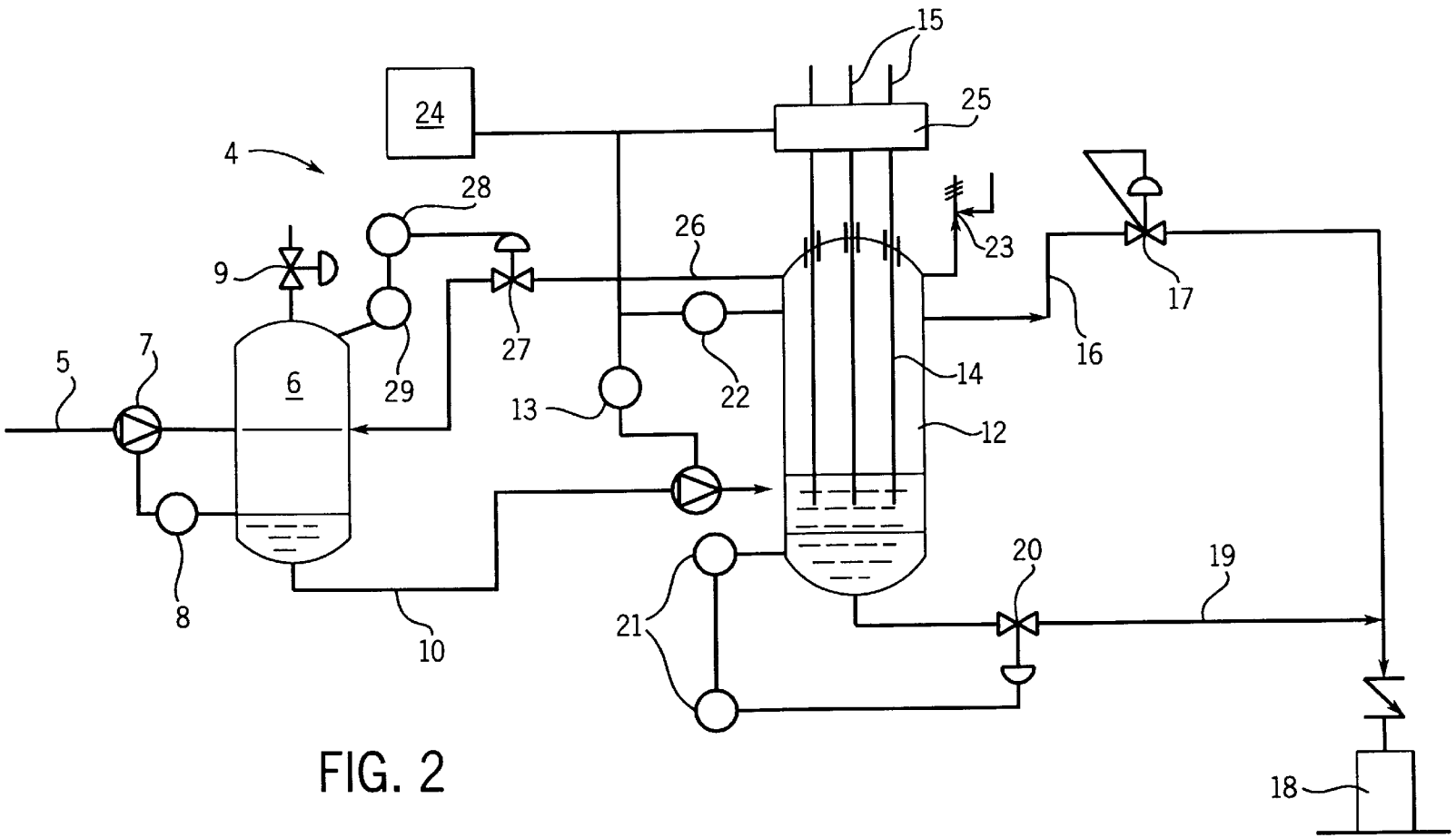
FIG. 2 is a principle drawing of a steam-generating unit.
Figure 3:
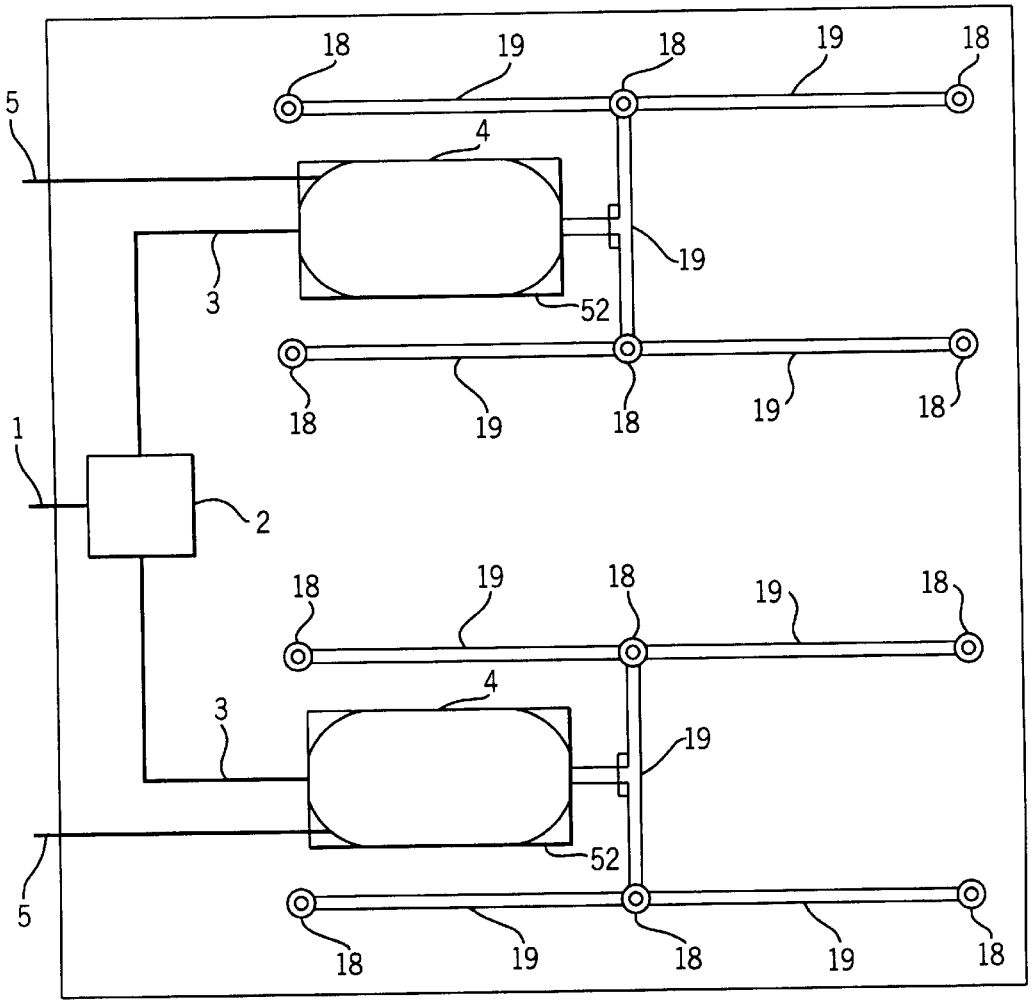
FIG. 3 is a drawing of a plurality of steam-generating units delivering steam to adjacent well bores.

FIG. 2 illustrates a preferred steam-generation unit 4. Water for steam generation is fed though water feed line 5. The water from the water feed line 5 is fed into a de-aerator 6 by means of a feed pump 7. A level control unit 8, measuring the water level in the de-aerator 6 controls the pump 7. Air from the de-aerator 6 is vented to the atmosphere by a ventilation valve 9. De-aerated water leaves the de-aerator 6 in a water line 10.

The water in the water line 10 is pumped into a boiler 12 by means of a pump 11. Electrodes 14 supplied with electric power from power lines 15 heats the water in the boiler 12. Steam generated in the boiler 12 leaves the boiler 12 in steam line 16 and passes a reduction valve 17 before it is led to the well head 18 where it is injected into the well.

The pressure in the boiler is monitored by a pressure gauge 22. The pump 11 is controlled by control means 13 and 24 as a response to the pressure measured by the pressure gauge 22 and the power feed to the electrodes 14 as measured by a MW meter 25.

A pressure security valve 23 prevents a build up of a pressure above a given security level.

Blow down water from the boiler is fed to the well through a blow down water line 19 via a valve 20. The valve 20 is controlled by control means 21 as a response to the conductivity in the water in the boiler 12. The driving force for the blow down water is equal to the pressure drop in the reduction valve 17.

The de-aerator 6 is heated by return steam that is carried through a return steam line 26. The amount of steam returned in the return steam line 26 is regulated by a valve 27 and a control device 28 as a response to the internal pressure in the de-aerator as measured by a pressure gauge 29.

Each steam-generating unit is preferably mounted on a skid, frame or the like 52 to be able to move the unit from one well bore to another as needed.

An electric boiler requires water demineralisation to control water conductivity to avoid arcing between the electrodes. Salts have to be removed by means of inverse osmosis as for a conventional fired boiler. Additionally calcium and magnesium ions have to be removed in an ion exchanger. The conductivity of the feed water should be in the range 5–25 micro S/cm at 20° C. Before entering the boiler, the water must be degassed from oxygen and the pH has to be adjusted to 10–11 by adding NaOH.

A prerequisite for using the present system is the availability of electric power at a competitive price. Most likely the inventive system will be used in areas with hydroelectric or nuclear power. The inventive system can accept interruptions in power supply in periods, with only minor negative effects. An oil reservoir is thermal extremely slow. The field's oil production capacity is primarily influenced by the mean amount of heat injected per time unit (e.g. per year). For a power availability of 80% the capacity of the system has to be increased with 25% to catch up for the time of disconnection. Each steam generation unit preferably has a remote control system 50 (see FIG. 1) making it possible to disconnect and start up the system. In this way only the steam generation units are shut down during the disconnection periods and not the electric supply to the rest of the electric powered equipment on the oil field that should up and running.

The system according to the present invention has the advantage compared with prior art that emissions of flue gas are avoided. Accordingly, the present system may be preferred in areas having restrictions on emissions to the atmosphere, e.g. California.

Another advantage is that the present system is less complex than the centralised gas fired boilers used in the prior systems. An electric boiler and an electric distribution system are easier to maintain and operate than gas fired boilers and a steam distribution system.

The inventive system is more energy efficient than a centralised gas fired boiler system since the transmission losses are reduced from about 30% for a system according to prior art down to 2–5% for the present decentralised system. Additionally, the efficiency for an electric boiler is close to 99%, compared with a fired boiler, which typically is designed for a thermal efficiency of 85%. This results in total energy efficiency for the inventive system of about 95%, including power distribution, steam piping and water treatment. At 50% load the energy efficiency of the inventive system drops 1% or 2%. As a comparison, the steam distribution system according to prior art has an energy efficiency of about 70% at full load, dropping to 55% at 50% load.

Even if only the use of traditional electrode boilers has been described as the electric boilers in the present invention, it is obvious for the man skilled in the art that other kinds of electric boilers may be used. Examples of other kinds of electric boilers are water jet boilers and dual circuit boilers.

What is claimed is:

1. A system for generation of steam for injection into a plurality of a well bores in an oil field to improve the oil recovery from the oil field, wherein the system comprises a plurality of electric powered steam-generating units, each unit delivering steam for injection into one well bore or a number of geographically close well bores.

2. The system according to claim 1, wherein each steam-generating unit comprises an electric boiler supplied with electric power from an electric power distribution net.

3. The system according to claim 1, wherein each steam-generation unit comprises equipment for remote control.

4. The system according to claim 1, wherein each steam-generation unit comprises a de-aerator.

5. The system according claim 1, wherein each steam generating unit is mounted on a separate transportable frame or skid for transport from one well bore to another.

6. A steam-generating unit for generation of steam for injection into a well bore in an oil field to improve the oil recovery from the oil field, wherein said steam generation unit comprises an electric boiler and additional equipment mounted on a transportable skid or frame for transport from one well bore to another.

7. The steam-generating unit according to claim 6, wherein said steam-generating unit also comprises equipment for remote control.

8. The steam-generating unit according to claim 6, wherein said steam-generating unit comprises a de-aerator.

9. A method of using plurality of electric powered steam-generating units for generation of steam for injection into a plurality of well bores in an oil field to improve the oil recovery from the oil field, wherein each steam-generating unit delivers steam for injection into one well bore or a number of geographically close well bores.

* * * * *